US006641514B1

(12) United States Patent
Hechler

(10) Patent No.: US 6,641,514 B1
(45) Date of Patent: Nov. 4, 2003

(54) BUCKLE FOLDING UNIT AND METHOD FOR CONTROLLING THE REGISTER OF A BUCKLE FOLDING UNIT

(75) Inventor: Hatto Hechler, Stuttgart (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/472,058

(22) Filed: Dec. 23, 1999

(30) Foreign Application Priority Data

Dec. 23, 1998 (DE) ..... 198 60 070

(51) Int. Cl.[7] ..... B31B 1/00

(52) U.S. Cl. ..... 493/8; 493/13; 493/23; 493/420; 493/421

(58) Field of Search ..... 493/13, 8, 23, 493/14, 15, 420, 419, 17, 18, 421

(56) References Cited

U.S. PATENT DOCUMENTS 5,037,364 A * 8/1991 Whittenberger
5,047,003 A * 9/1991 Schmidlin et al.
5,092,832 A * 3/1992 Crowley
5,242,364 A * 9/1993 Lehmann ..... 493/8
5,246,415 A * 9/1993 Fuss ..... 493/28
5,514,066 A * 5/1996 Monaco ..... 493/25
5,683,338 A * 11/1997 Krasuski et al.
5,871,433 A * 2/1999 Lehmann et al. ..... 493/420
5,967,963 A * 10/1999 Gotting
5,980,439 A * 11/1999 Johnson et al.
6,024,682 A * 2/2000 Mandel et al.
6,086,522 A * 7/2000 Hechler

FOREIGN PATENT DOCUMENTS

DE 90 06 855.6 U1 10/1990
EP 0 732 293 A2 9/1986
EP 0 913 352 A2 5/1999

* cited by examiner

*Primary Examiner*—Eugene Kim
(74) *Attorney, Agent, or Firm*—Laurence A. Greenberg; Werner H. Stemer; Ralph E. Locher

(57) ABSTRACT

A buckle folding unit with a folding pocket having an adjustable pocket stop, includes a first detector for detecting a first instant as a sheet travels from an inlet to the buckle folding unit until it reaches the pocket stop, a second detector for detecting a second instant as the sheet travels from a formation of a fold as far as an outlet from the folding pocket, and a device for determining a length of the sheet conveyed between the first and the second instants; a method for controlling the register of the buckle folding unit; and a folding machine having at least one buckle folding unit constructed with at least one of the foregoing features.

28 Claims, 4 Drawing Sheets

BUCKLE FOLDING UNIT AND METHOD FOR CONTROLLING THE REGISTER OF A BUCKLE FOLDING UNIT

BACKGROUND OF THE INVENTION

1. Field of the Invention

The invention relates to a buckle folding unit or pocket folding unit having an adjustable folding pocket. The invention also relates to a method for controlling the register of a buckle folding unit.

Heretofore known buckle folding units have three folding rollers which are jointly driven and rotate at the same speed, and a folding pocket. The folding rollers are essentially arranged at the corners of a right-angled triangle, the two folding rollers that are disposed vertically above one another conveying the incoming sheet into the folding pocket as far as a pocket stop that is adjustable as desired. The sheet is conveyed into the pocket at a travel speed that is matched to the composition of the paper. When the leading edge of the sheet strikes the pocket stop, and if the sheet is simultaneously conveyed further, a suspended buckle fold is formed in the buckling space between the three folding rollers, and the fold is gripped by the two folding rollers which are disposed horizontally beside one another and rotate in opposite directions. As the buckle fold passes through the folding rollers, the fold is then formed. The pocket stop, the width of the folding pocket and the position of the pocket mouth and of the pocket lips in relation to the buckling space have to be adjusted to the quality of the paper that is used and to the sheet format. These adjustments must also be made if the atmospheric humidity changes, because the stiffness of the paper is changed thereby. Furthermore, a change in the production speed has the effect of a change in the deformation of the sheet in the folding pocket and in the buckling space, so that the position of the fold on the sheet is displaced, and the folding unit may possibly have to be readjusted. The positional deviation of the fold on the sheet can, in this regard, only be detected on the finished folded sheet.

2. Summary of the Invention

It is an object of the invention to provide a buckle folding unit with which deviations of the fold position on a folded sheet can be detected during production. It is, furthermore, an object of the invention to provide a buckle folding unit with which control of the position of the fold on the sheet is made possible. It is also an object of the invention to provide a method for controlling the register of a buckle folding unit which ensures a constant position of the fold on the sheet in the event of a change in the production speed or paper stiffness.

With the foregoing and other objects in view, there is provided, in accordance with one aspect of the invention, a buckle folding unit with a folding pocket having an adjustable pocket stop, comprising a first detector for detecting a first instant as a sheet travels from an inlet to the buckle folding unit until it reaches the pocket stop, a second detector for detecting a second instant as the sheet travels from a formation of a fold as far as an outlet from the folding pocket, and a device for determining a length of the sheet conveyed between the first and the second instants.

In accordance with another feature of the invention, the first detector serves for detecting entry of the sheet into the buckle folding unit.

In accordance with a further feature of the invention, the first detector for detecting entry of the sheet into the buckle folding unit has at least one optical sensor.

In accordance with an added feature of the invention, the folding pocket has a pocket mouth with a lower lip, and the second detector serves for detecting a deflection of the pocket lower lip as the fold is formed.

In accordance with an additional feature of the invention, the second detector serving for detecting the deflection of the pocket lower lip is constructed as a displacement detector.

In accordance with yet another feature of the invention, the second detector serving for detecting the deflection of the pocket lower lip has at least one optical sensor.

In accordance with yet a further feature of the invention, the second detector serving for detecting the deflection of the pocket lower lip has a wire strain-gauge device on the pocket lower lip.

In accordance with yet an added feature of the invention, the second detector serving for detecting the deflection of the pocket lower lip has a piezo-electric sensor disposed on the pocket lower lip.

In accordance with yet an additional feature of the invention, the first detector serves for detecting entry of the sheet into the folding pocket, and the second detector serves for detecting exit of the sheet from the folding pocket.

In accordance with still another feature of the invention, the folding pocket has a pocket mouth, and the first and the second detectors, respectively, serving for detecting entry and exit of the sheet, are arranged at the pocket mouth.

In accordance with still a further feature of the invention, the first and the second detectors, respectively, serving for detecting entry and exit of the sheet have a common optical sensor.

In accordance with still an added feature of the invention, the device for determining the length of the sheet conveyed between the first and the second instants has a pulse generator assigned to a folding roller, and a counting device.

In accordance with still an additional feature of the invention, the first detector for detecting the first instant serves for detecting a leading edge of the sheet at a defined position on a sheet path, and the second detector for detecting the second instant serves for detecting a folded edge of the sheet that has been folded.

In accordance with another feature of the invention, the second detector for detecting the folded edge of the sheet that has been folded includes a light barrier having a transmitter for emitting electromagnetic radiation and an associated receiver for receiving the electromagnetic radiation.

In accordance with a further feature of the invention, a straight connecting line between the transmitter and the receiver is disposed at an angle to the axes of the folding rollers.

In accordance with an added feature of the invention, the second detector for detecting the folded edge of the sheet that has been folded includes a light barrier having a laser-light transmitting unit and a laser-light receiver.

In accordance with an additional feature of the invention, the folding pocket is adjustable and has at least one electrically activated actuating device, and the buckle folding unit includes a control unit for processing signals from the first detector for detecting the first instant, the second detector for detecting the second instant, and the device for determining the length of the sheet conveyed between the first and the second instants, the electrically activated actuating device of the folding pocket being drivable by the length-determining device.

In accordance with yet another feature of the invention, the buckle folding unit includes a folding pocket stop adjustable by the electrically activated actuating device.

In accordance with yet a further feature of the invention, the folding pocket has a width that is adjustable by the electrically activated actuating device.

In accordance with yet an added feature of the invention, the buckle folding unit includes at least one folding pocket adjustable by the electrically activated actuating device.

In accordance with yet an additional feature of the invention, the folding pocket has a folding pocket mouth displaceable by the electrically activated actuating device for varying a buckling space in the folding pocket.

In accordance with still another feature of the invention, the control unit has a microprocessor.

In accordance with still a further feature of the invention, the buckle folding unit includes at least one optical sensor for detecting a start of a printed image on an incoming sheet.

In accordance with still an added feature of the invention, the control unit serves also for processing a signal from the optical sensor for detecting the start of a printed image.

In accordance with another aspect of the invention, there is provided a method for controlling the register of a buckle folding unit, which comprises determining, in a learning phase, a desired value of a length of a sheet conveyed between a first and a second instant, and controlling to the desired value, during production operation, a determined actual value of the conveyed length of the sheet by driving an electric actuating device.

In accordance with another mode, the method of the invention includes, for controlling to a start of a printed image on a sheet, determining for each incoming sheet, a difference in length between entry of the sheet and the start of the printed image on the sheet.

In accordance with a further mode, the method of the invention includes controlling out fluctuations in the length difference so as to maintain a constant relationship between the start of a printed image and the position of the fold.

In accordance with an added mode, the method of the invention includes correcting the desired value with the length difference between the entry of the sheet and the start of the printed image.

In accordance with a concomitant aspect of the invention, there is provided a folding machine having at least one buckle folding unit constructed in accordance with at least one of the foregoing features.

Thus, the invention provides a buckle folding unit having a folding pocket with an adjustable pocket stop, wherein a device is provided for detecting a first instant as a sheet runs from an inlet to the buckle folding unit until it reaches the pocket stop, a device is provided for detecting a second instant as the sheet runs from the formation of the fold as far as the outlet from the folding pocket, and a device is provided for detecting the sheet length conveyed between the first and second instants.

The invention is based upon the finding that the deviation of the position of the fold on the sheet depends upon the sheet length conveyed between an instant located before the sheet is buckled in the folding pocket or in the buckling space, and an instant at which the fold is formed, but can also be detected at an instant at which the formation of the fold has already been carried out and the buckling of the sheet is no longer present. In specific terms, if the sheet has a lower stiffness than its intended stiffness in set-up operation, then the sheet will be excessively deformed in the folding pocket or in the buckling space, so that a greater sheet length than in set-up operation will be conveyed into the folding pocket or the buckling space. Consequently, the formation of the fold takes place only at a later instant, after a greater sheet length has been conveyed than in set-up operation. The deviation of the position of the fold on the sheet can therefore be carried out by determining the sheet length conveyed up to the formation of the fold, but also by determining the sheet length conveyed up to an instant at which the formation of the fold has already taken place and the buckling of the sheet is no longer present. During set-up operation, a desired value, which identifies the proper formation of a fold, can be determined for the conveyed sheet length. The deviation in the position of the fold can therefore be determined through a deviation of the conveyed sheet length from the desired value.

In an improvement in the invention, provision is made for the folding pocket to have a pocket mouth with a lower lip, and for the device for detecting the second instant to be constructed as a device for detecting the deflection of the pocket lower lip as the fold is formed. At the instant at which the fold is formed, the part of the sheet that extends into the folding pocket rests on the pocket lower lip and exerts pressure on the latter. As a result, the pocket lower lip is deflected at the instant the fold is formed. Detecting the deflection of the pocket lower lip therefore provides a simple and reliable possibility for detecting the instant at which the fold is formed. The deflection of the pocket lower lip can be carried out in this case via wire strain gauges, piezo-electric sensors or optical sensors.

A further developed measure provides for the device for detecting the first instant to be constructed as a device for detecting the entry of the sheet into the folding pocket, and the device for detecting the second instant to be constructed as a device for detecting the exit of the sheet from the folding pocket. As a result of these measures, the deviation of the fold position can be detected via a distance measurement, specifically the conveyed sheet length, and in particular, exact detection of the instant at which the fold is formed is unnecessary.

Provision is further made for the folding pocket to have a pocket mouth, and for the device for detecting the entry of the sheet and the exit of the sheet to be arranged on the pocket mouth. In this way, the buckling of the sheet in the folding pocket over the entire length thereof can be taken into account, as a result of which the magnitude of the deviation from the desired value is relatively high, and the deviation is therefore easy to detect.

A further developing measure provides for the device for detecting the entry of the sheet and the device for detecting the exit of the sheet to have a common optical sensor. Such a construction of the buckle folding unit according to the invention is particularly simple and can be implemented cost-effectively. A deviation in the fold position can therefore be detected using only one optical sensor and a device for determining the conveyed sheet lengths. In the case of such an arrangement, the fold on the sheet is displaced by half the deviation of the conveyed sheet length from the desired value.

Moreover, provision is made for the adjustable folding pocket to have at least one electrically activated actuating device, and for a control unit which processes the signals from the device for detecting a first instant, the device for detecting a second instant, and the device for determining the sheet length conveyed between the first and second instants, and which drives the electrically activated actuating device of the folding pocket. Going beyond the simple detection of a displacement of the fold position on the sheet, this provides the possibility of automatically controlling out any deviation of the position of the fold in the sheet. Because the actuating device of the folding pocket is driven, the length of the portion of the sheet pushed into the folding pocket during the formation of the buckle fold in the buckling space can be influenced. It is thereby possible to compensate for changed deformation of the sheet during the buckling operation, for example, as a result of a higher production speed or a change in the paper stiffness. The actuating devices provided can be actuating motors provided with a potentiometer or stepping motors. The actuating device can displace, for example, a folding pocket stop, the folding pocket width, at least one folding pocket lip or the folding pocket mouth. The control unit advantageously has a microprocessor.

According to an advantageous development of the invention, optical sensors are also provided for detecting the start of the printed image on an incoming sheet. This embodiment of the invention is particularly advantageous when, for example, a brochure or a prospectus is to be produced, in which the printed image is displaced or fluctuates in relation to the sheet start. In the case of such sheets, the fold must be placed exactly in relation to the printed image, because otherwise, in the event of fluctuations between the sheet start and the start of the printed image, the edge has to be trimmed off from time to time. The detection of the start of the printed image is possible in a simple way using an optical sensor which measures the transmission or reflection of the sheet.

It is advantageous for the control unit also to process the signal from the sensor for detecting the start of the printed image. In the event of deviations in the position of the printed image on a sheet, too, the exact position of the fold can be secured by including the signal from the printed-image sensor. Faulty end products are thereby avoided.

The invention also provides a method for controlling the register of a buckle folding unit, according to which, in a learning phase, a desired value of the sheet length conveyed between the first and second instants is determined and, during production operation, a determined actual value of the sheet length conveyed is controlled to the desired value by driving the electrical actuating device. By employing such a method, after the learning phase has been concluded, the production speed of a folding machine provided, for example, with a number of buckle folding units according to the invention can be changed without requiring any adjustments to be performed manually. Using such a method, it is also possible to compensate for a change in the paper stiffness, for example, due to a varying atmospheric humidity.

In the case of controlling to the start of the printed image, provision is likewise made for a length difference between the entry of the sheet and the start of the printed image to be determined for each incoming sheet. A fluctuating length difference between the entry of the sheet and the start of the printed image, which would result in a fold position displaced in relation to the printed image, is recognized by this measure and can therefore be controlled out. This is preferably carried out by the desired value being corrected with the length difference between the entry of the sheet and the start of the printed image. By such a procedure, the required desired value is corrected only when control is directed to the start of the printed image, so that the method steps of controlling to the entry of the sheet can be maintained, and only have to be supplemented by a further correction step.

Other features which are considered as characteristic for the invention are set forth in the appended claims.

Although the invention is illustrated and described herein as embodied in a buckle folding unit and a method for controlling the register of a buckle folding unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
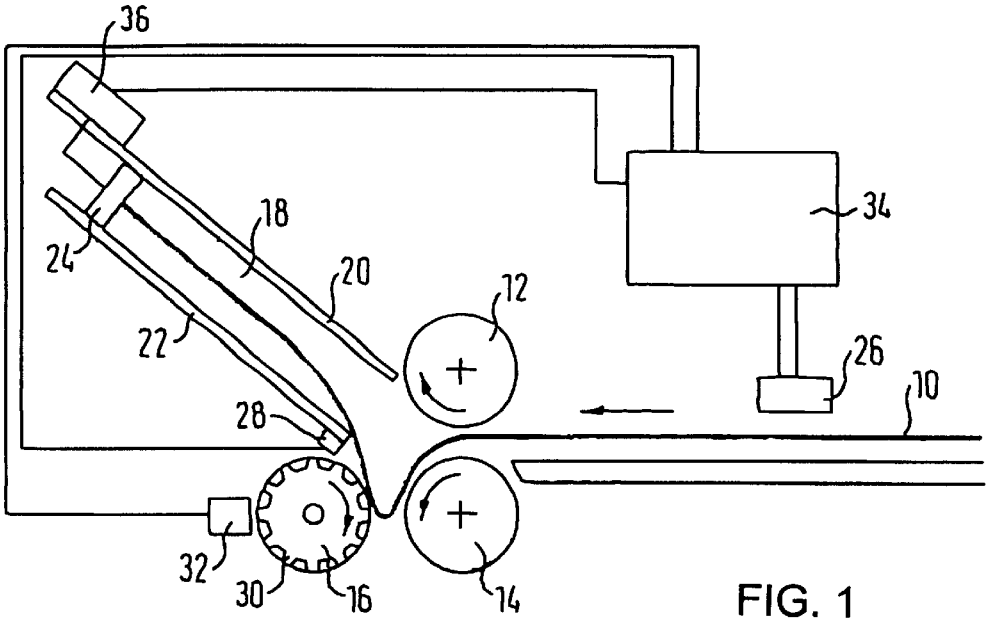
FIG. 1 is a schematic and diagrammatic view of a first embodiment of the buckle folding unit according to the invention during normal operation.

Referring now to the drawings and, first, particularly to FIG. 1 thereof, there is shown therein a folding unit according to the invention for processing a paper sheet 10. A first folding roller 12 is disposed vertically above a second folding roller 14. A further, third folding roller 16 is disposed horizontally beside the second folding roller 14. All three folding rollers 12, 14 and 16 are driven conjointly and have the same circumferential speed. In order to draw the sheet 10 in and to convey it farther in the folded state, the folding rollers 12 and 14, on the one hand, and 14 and 16, on the other hand, respectively, rotate in opposite directions. FIG. 1 shows the instant of fold formation, at which the buckle fold formed in the buckling space between the three folding rolls 12, 14 and 16 is gripped by the two folding rollers 14 and 16 rotating in opposite directions. This buckle fold is then drawn in and, as a result, the sheet is conveyed downwardly out of the folding unit, for example, to a further folding unit in a folding machine. The folding unit illustrated in FIG. 1 also has a folding pocket 18 with a pocket mouth adjoining the buckling space between the folding rolls 12, 14 and 16. The pocket mouth is in turn formed by a pocket upper lip 20 and a pocket lower lip 22. A pocket stop 24 is provided to limit the length of the sheet pushed into the folding pocket.

In the illustrated embodiment of the invention, a first instant is determined when the leading edge of the sheet 10 passes underneath an optical sensor 26. The sensor 26 is also able to detect the start of the printed image on the sheet 10. The sensor 26 emits or outputs a signal both when the leading edge of the sheet 10 passes by and when the printed image on the sheet 10 passes under the sensor 26. The instant at which the fold is formed is registered by a sensor 28, which is arranged on the pocket lower lip 22. At the instant at which the fold is formed, as illustrated in FIG. 1, that part of the sheet 10 which extends into the folding pocket 18 rests on the pocket lower lip 22 and exerts pressure on the latter, so that the pocket's lower lip 22 is deflected. This deflection is registered by the sensor 28, which is constructed, for example, as a wire strain gauge device. In order to determine the length of the part of the sheet 10 that is conveyed between the first instant, determined by the sensor 26, and the second instant, determined by the sensor 28, the folding roller 16 is provided with teeth 30 on the circumference thereof. These teeth 30 run past a sensor 32 which, for example, is formed by an optical sensor. The sensor 32 outputs a train of pulses, which are counted by a counting device in an evaluation and control unit 34. Because the number of teeth 30 on the folding roller 16 is known, the conveyed sheet length can also be determined in the evaluation and control unit 34 by using the counted pulses and the known circumference of the folding rollers 12, 14 and 16.

The signals from the sensors 26, 28 and 30 are made available to the evaluation and control unit 34. The control unit 34 drives an actuating device 36, which adjusts the pocket stop 24 in the folding pocket 18.

In FIG. 1 the buckle folding unit according to the invention is illustrated during a learning phase wherein a desired value of the sheet length conveyed between the first and second instants is determined. After the learning phase has been concluded, this desired value is available to the control unit 34.

Figure 2:
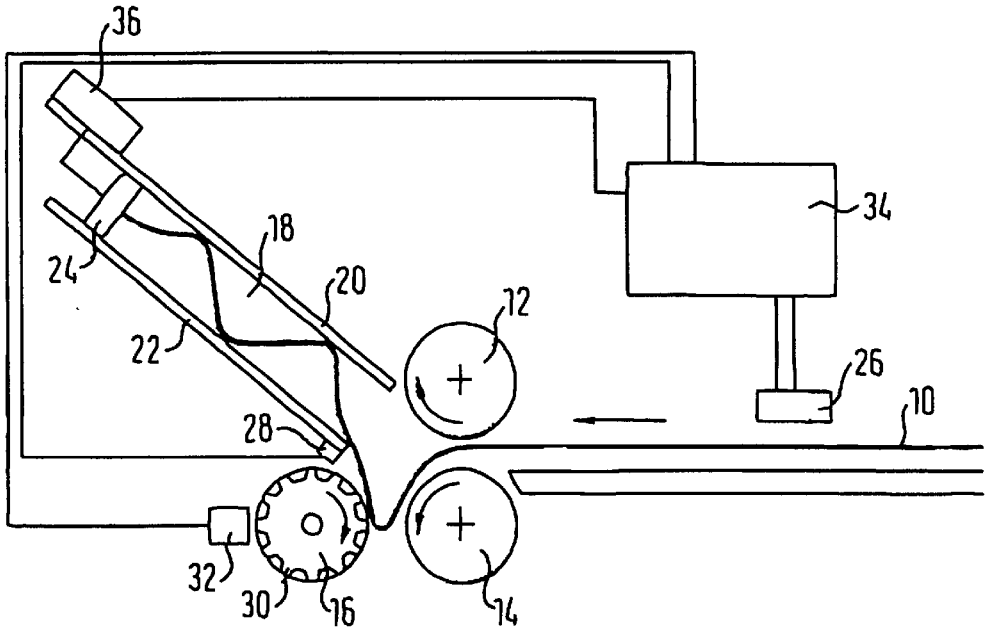
FIG. 2 is a view like that of FIG. 1 of the buckle folding unit which is operating with a higher sheet speed or lower paper stiffness.

FIG. 2 shows the buckle folding unit of FIG. 1 when there is an increase in the production speed or a change in the paper stiffness, so that that part of the sheet 10 pushed into the folding pocket 18 is excessively deformed. At the instant illustrated in FIG. 2, at which the fold is formed, a sheet length has therefore been conveyed that is greater than that at the instant, illustrated in FIG. 1, at which the fold was formed in the learning phase. Consequently, the result is a deviation of the actual value of the sheet length which was conveyed between the first instant, at which the leading edge of the sheet 10 passes under the sensor 26, and the second instant, at which the formation of the fold was determined by the deflection of the pocket lower lip 22 by the sensor 28. This deviation of the actual value from the desired value is detected by the evaluation and control unit 34, and the evaluation and control unit 34 then drives the actuating device 36 in such a way that the latter displaces the pocket stop 24 in the direction of the buckling space, as a result of which a shorter sheet length is conveyed into the folding pocket 18 and the buckling space. Consequently, by displacing the pocket stop 24 in the direction of the buckling space and in the opposite direction, control of the determined actual value of the conveyed sheet length to the desired value determined in the learning phase can be achieved.

Figure 3:
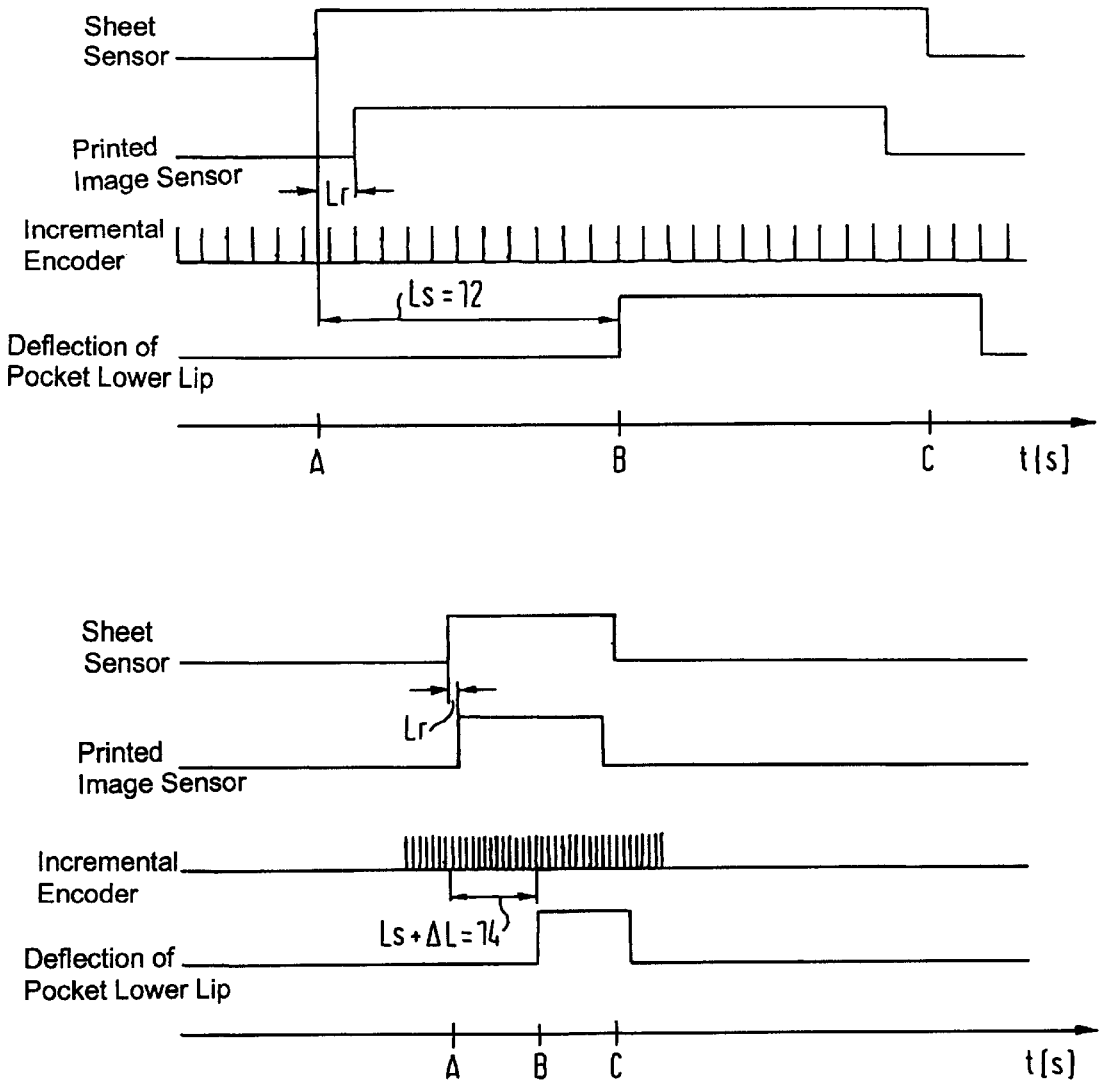
FIG. 3 are plot diagrams representing the time coordination of the sensor signals of the embodiment of FIG. 1 at low and high speeds, respectively.

FIGS. 3*a* and 3*b* illustrate the time coordination of the sensor signals from the sensors 26, 28 and 32 of FIGS. 1 and 2 in diagrammatic form. In the upper graph or plot diagram of FIG. 3*a*, the sensor signals are shown at low speed, i.e., the condition of FIG. 1. At the instant A, the sheet/printed image sensor 26 detects the entry of the sheet. After two pulses from the incremental encoder 32, the start of the printed image on the sheet is likewise detected by the sheet/printed image sensor 26. As a result, a correction value Lr is determined, which is required for a control to the start of the printed image on a sheet. At the instant B, the formation of the fold takes place, which is detected by the signal from the sensor 28 that registers a deflection of the pocket lower lip 22. Between the entry of the sheet A and the formation of the fold B, there are twelve pulses from the incremental encoder 32 here, so that the desired value determined in the learning phase for the conveyed sheet length between the entry of the sheet and the formation of the fold is defined as Ls=12 pulses. At the instant C, the conveyed sheet has finally passed the sensor 26 completely, so that the signal from the sensor 26 returns to a low level.

The lower plot diagram of FIG. 3*b* corresponds to the time coordination of the sensor signals in the condition shown in FIG. 2, i.e., at a higher speed. At the instant A, the entry of the sheet is again registered by the sheet/printed image sensor 26 and, two pulses from the incremental encoder 32 later, the start of the printed image on the sheet is detected. This corresponds to the correction value Lr. At higher speed, the sheet is deformed in a wavelike or corrugated manner in the folding pocket 18, as shown in FIG. 2, so that a greater sheet length is conveyed into the folding pocket 18 before the buckle fold can be formed. The instant B, at which the sensor 28 detects the formation of the fold, therefore, follows later, so that a sheet length Ls+ΔL is conveyed between the entry of the sheet A and the formation of the fold B. In the example shown in FIG. 3*b*, ΔL is two pulses. In order to compensate for this additionally conveyed sheet length ΔL, it is therefore necessary for the control unit 34 to drive the actuating motor 36 in such a way that the latter displaces the folding pocket stop 24 until the number of pulses detected between the entry of the sheet A and the formation of the fold B once again corresponds to the desired value Ls.

Figure 4:
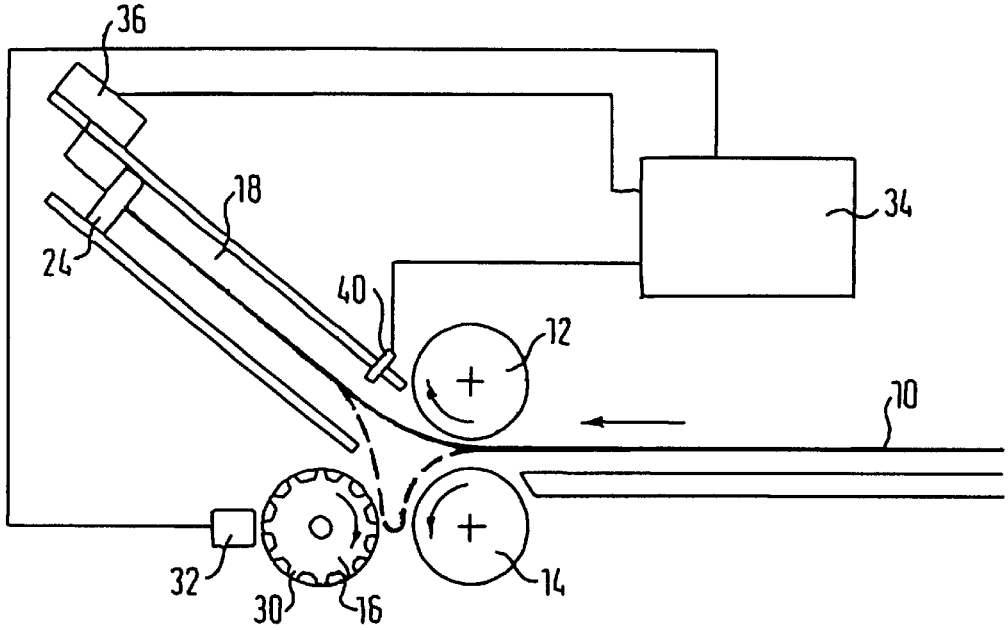
FIG. 4 is a view like that of FIG. 1 of a second embodiment of the buckle folding unit according to the invention.
Figure 5:
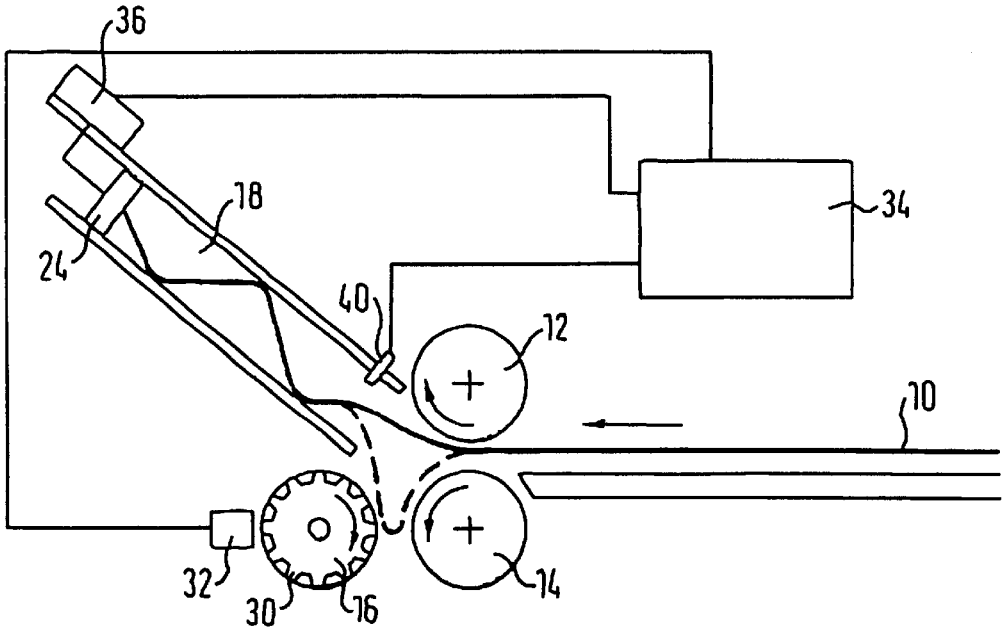
FIG. 5 is a view like that of FIG. 4 wherein the buckle folding unit is operating with a higher sheet speed or lower paper stiffness.

A second embodiment of the buckle folding unit according to the invention is illustrated in FIGS. 4 and 5. Components in FIGS. 4 and 5 which are identified by the same reference characters as in FIGS. 1 and 2 are of like construction as those shown in FIGS. 1 and 2. A value of the conveyed sheet length is determined here with the aid of the signals from an optical sensor 40, which is arranged as close as possible to the pocket mouth of the folding pocket 18, between the pocket bars or lips 20 and 22. The optical sensor 40 is covered as the sheet leading edge enters and is exposed as it exits, so that the entry of the leading edge of the sheet 10 into the folding pocket 18 and the exit of the leading edge of the sheet 10 after a fold has been formed are registered. The formation of the buckle fold in the buckling space between the folding rollers 12, 14 and 16 is illustrated by a broken line in FIG. 4. The sheet length conveyed between the instant at which the leading edge of the sheet 10 enters the folding pocket 18 and the exit thereof from the folding pocket 18 is determined, as in the embodiment shown in FIGS. 1 and 2, with the aid of the teeth 30 arranged on the folding roller 16, the sensor 30 and the evaluation and control unit 34, in that the pulses from the sensor 32, which occur between the covering of and the exposure of the sensor 40 and which correspond to the distance increments, are counted. The measured conveyed sheet length therefore corresponds, in the case of a sheet lying flat, to twice the distance from the sensor 40 to the pocket stop 24, plus the sheet length conveyed in order to form the buckle fold in the buckling space. This sheet length conveyed in order to form the buckle fold results from the difference between the sheet length located as the buckle fold in the buckling space, which is illustrated by a broken line in FIGS. 4 and 5, and the extended sheet length through the buckling space before the buckle fold is formed, which is illustrated by a continuous or solid line. This sheet length, conveyed in order to form the buckle fold, is independent of the production speed of the buckle folding unit.

FIG. 5 shows the buckle folding unit of FIG. 4 at a higher production speed or a lower paper stiffness. The buckle fold forming in the buckling space between the folding rollers 12, 14 and 16 is again illustrated by a broken line. It is apparent that, under the conditions illustrated in FIG. 5, an increased sheet length has been conveyed into the folding pocket 18 and, as a result, the fold has been displaced. When the leading edge of the sheet 10 enters the folding pocket 18, the sheet 10 has not yet been buckled, and when the leading edge of the sheet 10 exits from the folding pocket 18, the buckling of the sheet 10 is no longer present. If, therefore, in the learning phase illustrated in FIG. 4, a desired value of the required sheet length Ls were registered, then under the conditions illustrated in FIG. 5, a length $Ls+\Delta L$ is registered by the sensor 40. The position of the fold on the sheet is therefore displaced by $\Delta S=0.5\times\Delta L$, so that the pocket stop 24 has to be displaced in th e direction of the buckling space a distance AS with the aid of the actuating device 36, in order for the fold to be located again at the original point.

The embodiment illustrated in FIGS. 4 and 5 of the buckle folding unit according to the invention is, on the one hand, particularly simple to implement, since only an optical sensor 40 is necessary in order to determine the instants relevant for the conveyed sheet length, on the other hand, the buckle folding unit shown is especially nonsusceptible to disruption, because the passage of the leading edge of the sheet 10 underneath the sensor 40 is detected by the optical sensor 40, and the detection of a relatively low deflection of a component at the instant at which the fold is formed is not required.

Figure 6:
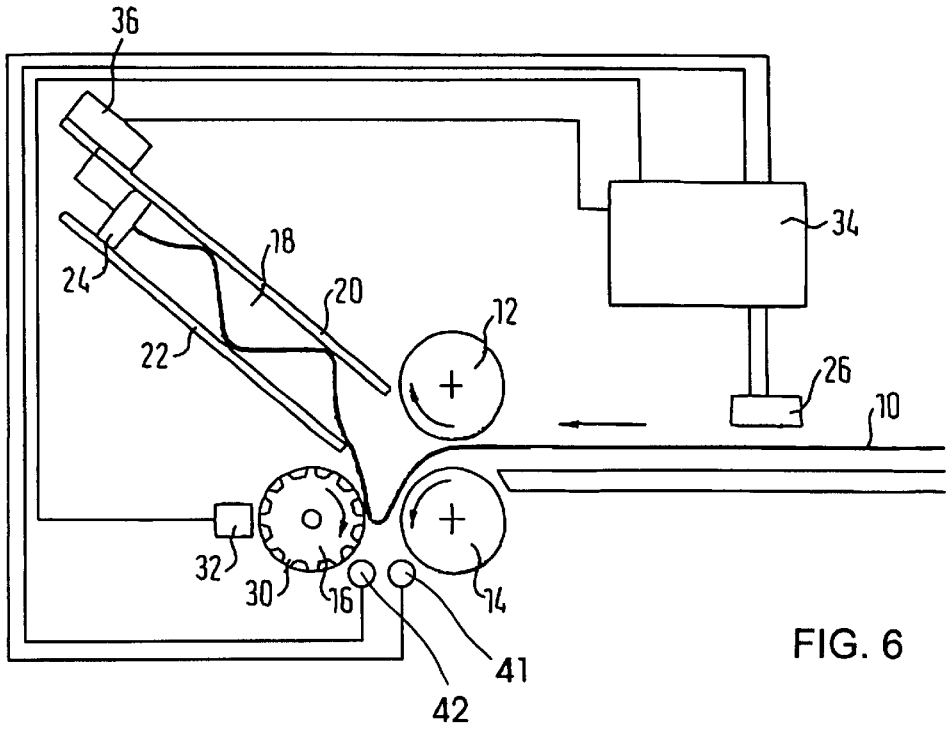
FIG. 6 is a view like that of FIG. 2 of a third embodiment of the invention.
Figure 7:
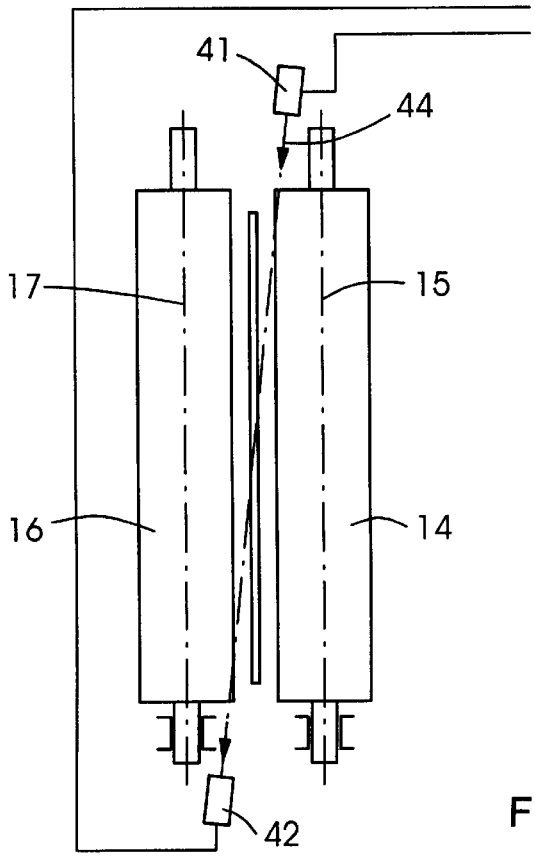
FIG. 7 is a fragmentary diagrammatic and schematic top plan view of FIG. 6, showing a pair of folding rollers in the third embodiment of the buckle folding unit according to the invention.

A third embodiment of the buckle folding unit according to the invention is illustrated in FIGS. 6 and 7. Components illustrated in FIGS. 6 and 7 which are identified by the same reference characters as in FIGS. 1 and 2 are of like construction, respectively. In this embodiment of the invention, a value of the conveyed sheet length may then be determined by a first instant again being determined first, at which the leading edge of the sheet 10 passes a specific, defined point on the sheet path. The sensor 26 can be disposed at any desired distance in front of the pocket mouth or as close as possible to the pocket mouth of the folding pocket 18. The instant the sensor 26, which is preferably constructed as an optical sensor, registers the passage of the leading edge of the sheet 10, the signal therefrom can again be forwarded to the evaluation and control unit 34. As aforedescribed in connection with the preceding figures, the evaluation and control unit 34 is therefore capable of counting pulses until the input of a second signal. According to the third configuration of the invention, this second signal is attained due to the fact that a control light barrier disposed at the front side, downline of the folding rollers 14 and 16 and including a transmitter 41 and a receiver 42, is interrupted. Although it is possible at this point to employ a light barrier which operates with any desired electromagnetic radiation, use is preferably made here of a light barrier having a very narrow beam path. In this case, it is of particular advantage to employ a laser beam source and a corresponding laser sensor. The transmitter 41 and the receiver 42 are disposed at an angle to the folding rollers 14 and 16, as shown in FIG. 7. The light beam 44 originating from the transmitter 41 is therefore emitted in such a way that it does not run parallel to the two axes 15 and 17 of the folding rollers 14 and 16, respectively. Instead, the intention is to emit the light beam 44 from the light source 41 so that it travels at a small positive or negative angle, of preferably up to 20°, relative to one of the axes 15 or 17. With this arrangement of the transmitter 41 and the receiver 42, assurance is provided that the paper path of the immediately previously folded sheet cuts the beam path and, accordingly, a signal is generated which is in turn forwarded to the evaluation and control unit 34. With the second instant determined in this manner, it is possible, in accordance with the procedure described with regard to the preceding figures, to determine a value for the conveyed sheet length. If this value does not correspond to the stored desired value, because of the buckling of the sheet already described in the preceding figures, once again the folding pocket stop 24 can be displaced via the evaluation and(control unit 34 until the desired sheet length has been reached.

In the preceding figures, the determination of the sheet length was described with the aid of a folding roller 16 having teeth 30 which are provided on the circumference thereof. As a these teeth run past a sensor 32, they generate pulses which are then in turn output to the evaluation and control unit 34. In addition to this particularly advantageous embodiment of the invention, it is of course also possible to use another incremental encoder that is coupled or coordinated with the paper travel speed, especially to the rotational speed of the folding rollers 14 and 16.

I claim:

1. A buckle folding unit to be supplied with sheets running-in one after another, comprising:

an adjustable folding pocket having a pocket stop and an outlet;

rollers having parallel center lines and being adapted for conveying a respective sheet into said folding pocket until a leading edge of said sheet abuts said pocket stop and for folding and pulling said sheet out of said outlet;

a sheet detecting device for generating a first signal at an instant while a respective sheet is running-in and a second signal at an instant while said sheet is being pulled out of said outlet;

a determining device for determining an actual value of a furnished sheet length of a respective sheet within a time segment lasting from said first signal to said second signal; and an adjusting device for adjusting said fold pocket in dependence on a difference between said actual value and a predetermined nominal value of furnished sheet length.

2. The buckle folding unit according to claim 1, wherein said sheet detecting device includes a first detector for detecting entry of a respective sheet into the buckle folding unit and for generating said first signal.

3. The buckle folding unit according to claim 1, wherein said sheet detecting device has at least one optical sensor.

4. The buckle folding unit according to 2, wherein said folding pocket has a pocket mouth with a lower lip, and said sheet detecting device includes a second detector for detecting a deflection of said lower lip when said sheet is becoming folded and for generating said second signal.

5. The buckle folding unit according to claim 4, wherein said second detector is a displacement detector.

6. The buckle folding unit according to claim 4, wherein said second detector includes at least one optical sensor.

7. The buckle folding unit according to claim 4, wherein said second detector includes a strain-gauge device disposed at said lower lip.

8. The buckle folding unit according to claim 4, wherein said second detector includes a piezo-electric sensor disposed at said lower lip.

9. The buckle folding unit according to claim 1, wherein said sheet detecting device is disposed for detecting entry of a respective sheet into said folding pocket and for detecting exit of a respective sheet from said folding pocket.

10. The buckle folding unit according to claim 9, wherein said folding pocket has a pocket mouth forming said outlet, and said sheet detecting device being arranged at said pocket mouth.

11. The buckle folding unit according to claim 9, wherein said sheet detecting device includes a single sensor for detecting entry of a respective sheet into said folding pocket and exit of a respective sheet from said folding pocket.

12. The buckle folding unit according to claim 1, wherein said determining device includes a pulse generator assigned to one of said rollers, and a counting device cooperating with said pulse generator.

13. The buckle folding unit according to claim 1, wherein said sheet detecting device includes a first detector for generating said first signal by detecting a leading edge of a respective sheet at a defined position within the buckle folding unit, and a second detector for generating said second signal by detecting a folded edge of a respective sheet that has been folded.

14. The buckle folding unit according to claim 13, wherein said second detector includes a transmitter for emitting electromagnetic radiation and an associated receiver for receiving the electromagnetic radiation emitted by said transmitter.

15. The buckle folding unit according to claim 14, wherein a straight connecting line between said transmitter and said receiver is disposed at an angle to the center lines of said rollers.

16. The buckle folding unit according to claim 13, wherein said second detector includes a laser-light transmitter and a laser-light receiver.

17. The buckle folding unit according to claim 1, which further comprises:

at least one electrically activated actuating device; and a control unit for processing said first signal, said second signal, said actual value of furnished sheet length and said predetermined nominal value of furnished sheet length, and for generating a control signal;

said electrically activated actuating device being controlled by said control signal.

18. The buckle folding unit according to claim 17, wherein said pocket stop of said folding pocket is adjustable by said electrically activated actuating device.

19. The buckle folding unit according to claim 17, wherein said folding pocket has a width that is adjustable by said electrically activated actuating device.

20. The buckle folding unit according to claim 17, wherein said folding pocket is adjustable by said electrically activated actuating device.

21. The buckle folding unit according to claim 17, wherein said folding pocket has a folding pocket mouth displaceable by said electrically activated actuating device for varying a buckling space in the folding pocket.

22. The buckle folding unit according to claim 17, wherein said control unit has a microprocessor.

23. The buckle folding unit according to claim 17, wherein a respective sheet shows a printed image having a leading image edge, and said sheet detecting device includes at least one optical sensor for generating said first signal when being passed by said leading image edge.

24. A folding machine having at least one buckle folding unit constructed in accordance with the features of claim 1.

25. A method for controlling the register of a buckle folding unit having an inlet for receiving a sheet and a folding pocket with an outlet, which comprises:

providing the folding pocket with an adjustable pocket stop;

detecting a first instant as the sheet travels from the inlet to the buckle folding unit until it reaches the pocket stop;

detecting a second instant as the sheet travels from a formation of a fold as far as the outlet from the folding pocket;

determining, in a learning phase, a desired value of a length of a sheet conveyed between the first and the second instant;

determining, in a production phase, an actual value of the length of the sheet conveyed between the first and the second instant; and adjusting the actual value to the desired value, during production operation, by adjusting the pocket stop using an adjusting device, in order to compensate for changes in sheet properties or changes of sheet deformation due to changes in production speed.

26. The method according to claim 25, which includes, for controlling to a start of a printed image on a sheet, determining for each incoming sheet, a difference in length between entry of the sheet and the start of the printed image on the sheet.

27. The method according to claim 26, which includes controlling out fluctuations in the length difference so as to maintain a constant relationship between the start of a printed image and the position of the fold.

28. The method according to claim 26, which includes correcting the desired value with the length difference between the entry of the sheet and the start of the printed image.

* * * * *